US009613491B2

(12) United States Patent
Roth

(10) Patent No.: US 9,613,491 B2
(45) Date of Patent: Apr. 4, 2017

(54) VIDEO GAMING DEVICE HAVING A SYSTEM AND METHOD FOR COMPLETING WAGERS AND PURCHASES DURING THE CASH OUT PROCESS

(75) Inventor: Russell Robert Roth, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 11/305,796

(22) Filed: Dec. 16, 2005

(65) Prior Publication Data

US 2006/0135255 A1 Jun. 22, 2006

Related U.S. Application Data

(60) Provisional application No. 60/636,733, filed on Dec. 16, 2004.

(51) Int. Cl.
*A63F 9/24* (2006.01)
*G07F 17/32* (2006.01)

(52) U.S. Cl.
CPC ..... *G07F 17/3244* (2013.01); *G07F 17/32* (2013.01); *G07F 17/329* (2013.01); *G07F 17/3255* (2013.01); *G07F 17/3281* (2013.01); *G07F 17/3293* (2013.01)

(58) Field of Classification Search
CPC ..... G07F 17/323; G07F 17/3244; G07F 17/3255; G06Q 30/0207; G06Q 30/0209; G07C 15/005
USPC ..... 463/1, 25, 29
See application file for complete search history.

(56) References Cited

U.S. PATENT DOCUMENTS

| | | | |
|---|---|---|---|
| 3,708,219 | A | 1/1973 | Forlini et al. |
| 3,931,504 | A | 1/1976 | Jacoby |
| 4,333,715 | A | 6/1982 | Brooks |
| 4,430,728 | A | 2/1984 | Beitel et al. |
| 4,454,594 | A | 6/1984 | Heffron et al. |
| 4,517,558 | A | 5/1985 | Davids |
| 4,607,844 | A | 8/1986 | Fullerton |
| 4,621,814 | A | 11/1986 | Stepan et al. |
| 4,659,182 | A | 4/1987 | Aizawa |
| 4,718,672 | A | 1/1988 | Okada |
| 4,743,022 | A | 5/1988 | Wood |

(Continued)

FOREIGN PATENT DOCUMENTS

| | | |
|---|---|---|
| AU | 199650576 | 4/1997 |
| AU | 775882 | 8/2004 |

(Continued)

*Primary Examiner* — David L Lewis
*Assistant Examiner* — Robert Mosser
(74) *Attorney, Agent, or Firm* — Neal, Gerber & Eisenberg LLP

(57) ABSTRACT

The present invention is a method for completing wagers and purchases from a gaming device when a player presses or selects the cash out feature on the device. The present invention provides for a more convenient method for players to make additional gaming wagers and purchases directly from a gaming device. The player can select the option to make a wager on a sporting event, lottery game, Keno game or any game of chance offered by the gaming establishment. The present invention also enables the player to select the option to make purchases for among other things show tickets, sporting events, movies, retail items or even credit the proceeds from the gaming device to the players hotel room account.

8 Claims, 7 Drawing Sheets

(56) References Cited

U.S. PATENT DOCUMENTS 4,856,787 A 8/1989 Itkis
4,911,449 A 3/1990 Dickinson et al.
4,912,548 A 3/1990 Shanker et al.
5,086,354 A 2/1992 Bass et al.
5,113,272 A 5/1992 Reamey
5,121,477 A 6/1992 Koopmans et al.
5,132,839 A 7/1992 Travis
5,319,491 A 6/1994 Selbrede
5,342,047 A 8/1994 Heidel et al.
5,364,100 A 11/1994 Ludlow et al.
5,375,830 A 12/1994 Takemoto et al.
5,376,587 A 12/1994 Buchmann et al.
5,393,061 A 2/1995 Manship et al.
5,467,893 A 11/1995 Landis, II et al.
5,531,441 A 7/1996 Dabrowski et al.
5,539,547 A 7/1996 Ishii et al.
5,580,055 A 12/1996 Hagiwara
5,585,821 A 12/1996 Ishikura et al.
5,589,980 A 12/1996 Bass et al.
5,643,086 A 7/1997 Alcorn et al.
5,655,961 A 8/1997 Acres et al.
5,745,197 A 4/1998 Leung et al.
5,752,881 A 5/1998 Inoue
5,761,647 A 6/1998 Boushy
5,764,317 A 6/1998 Sadovnik et al.
5,785,592 A 7/1998 Jacobsen
5,851,149 A 12/1998 Xidos et al.
5,910,046 A 6/1999 Wada et al.
5,923,307 A 7/1999 Hogle, IV
5,951,397 A 9/1999 Dickinson
5,956,180 A 9/1999 Bass et al.
5,967,893 A 10/1999 Lawrence et al.
6,001,016 A 12/1999 Walker et al.
6,015,346 A 1/2000 Bennett
6,027,115 A 2/2000 Griswold et al.
6,050,895 A 4/2000 Luciano et al.
6,054,969 A 4/2000 Haisma
6,059,658 A 5/2000 Mangano et al.
6,068,552 A 5/2000 Walker et al.
6,099,408 A 8/2000 Schneier et al.
6,104,815 A 8/2000 Alcorn et al.
6,106,396 A 8/2000 Alcorn et al.
6,110,041 A 8/2000 Walker et al.
6,113,495 A 9/2000 Walker et al.
6,135,884 A 10/2000 Hedrick et al.
6,149,522 A 11/2000 Alcorn et al.
6,159,098 A 12/2000 Slomiany et al.
6,190,256 B1 2/2001 Walker et al.
6,203,428 B1 3/2001 Giobbi et al.
6,213,875 B1 4/2001 Suzuki
6,244,596 B1 6/2001 Kondratjuk
6,251,014 B1 6/2001 Stockdale et al.
6,252,707 B1 6/2001 Kleinberger et al.
6,253,374 B1 6/2001 Dresevic et al.
6,254,481 B1 7/2001 Jaffe
6,280,326 B1 8/2001 Saunders
6,293,866 B1 9/2001 Walker et al.
6,315,666 B1 11/2001 Mastera et al.
6,337,513 B1 1/2002 Clevenger et al.
6,347,996 B1 2/2002 Gilmore et al.
6,368,216 B1 4/2002 Hedrick et al.
6,379,244 B1 4/2002 Sagawa et al.
6,398,220 B1 6/2002 Inoue
6,416,827 B1 7/2002 Chakrapani et al.
6,444,496 B1 9/2002 Edwards et al.
6,445,185 B1 9/2002 Damadian et al.
6,446,257 B1 9/2002 Pradhan et al.
6,449,687 B1 9/2002 Moriya
6,453,319 B1 9/2002 Mattis et al.
6,454,648 B1 9/2002 Kelly et al.
6,459,440 B1 10/2002 Monnes et al.
6,491,583 B1 12/2002 Gauselmann
6,503,147 B1 1/2003 Stockdale et al.
6,508,710 B1 1/2003 Paravia et al.
6,511,375 B1 1/2003 Kaminkow
6,512,559 B1 1/2003 Hashimoto et al.
6,514,141 B1 2/2003 Kaminkow et al.
6,517,433 B2 2/2003 Loose et al.
6,517,437 B1 2/2003 Wells et al.
6,547,664 B2 4/2003 Saunders
6,575,541 B1 6/2003 Hedrick et al.
6,579,179 B2 * 6/2003 Poole et al. ..... 463/25
6,585,591 B1 7/2003 Baerlocher et al.
6,592,456 B2 7/2003 Walker et al.
6,620,047 B1 9/2003 Alcorn et al.
D480,961 S 10/2003 Deadman
6,638,163 B2 10/2003 Moody
6,645,077 B2 11/2003 Rowe
6,646,695 B1 11/2003 Gauselmann
6,648,757 B1 11/2003 Slomiany et al.
6,652,378 B2 11/2003 Cannon et al.
6,659,864 B2 12/2003 McGahn et al.
6,661,425 B1 12/2003 Hiroaki
6,695,703 B1 2/2004 McGahn
6,702,675 B2 3/2004 Poole et al.
6,712,694 B1 3/2004 Nordman
6,715,756 B2 4/2004 Inoue
6,717,728 B2 4/2004 Putilin
6,722,979 B2 4/2004 Gilmore et al.
6,729,956 B2 * 5/2004 Wolf et al. ..... 463/25
6,802,777 B2 10/2004 Seelig et al.
6,811,486 B1 11/2004 Luciano, Jr.
6,817,945 B2 11/2004 Seelig et al.
6,817,946 B2 11/2004 Motegi et al.
6,887,157 B2 5/2005 LeMay et al.
6,890,259 B2 5/2005 Breckner et al.
6,906,762 B1 6/2005 Witehira et al.
6,937,298 B2 8/2005 Okada
6,969,319 B2 11/2005 Rowe et al.
7,022,017 B1 4/2006 Halbritter et al.
7,063,617 B2 * 6/2006 Brosnan et al. ..... 463/25
7,095,180 B2 8/2006 Emslie et al.
7,097,560 B2 8/2006 Okada
7,128,647 B2 10/2006 Muir et al.
7,137,889 B1 * 11/2006 Luciano, Jr. ..... 463/25
7,159,865 B2 1/2007 Okada
7,160,187 B2 1/2007 Loose et al.
7,204,753 B2 4/2007 Ozaki et al.
7,207,883 B2 4/2007 Nozaki et al.
7,220,181 B2 5/2007 Okada
7,252,288 B2 8/2007 Seelig et al.
7,255,643 B2 8/2007 Ozaki et al.
7,309,284 B2 12/2007 Griswold et al.
7,322,884 B2 1/2008 Emori et al.
7,329,181 B2 2/2008 Hoshino et al.
7,618,319 B2 11/2009 Casey et al.
7,619,585 B2 11/2009 Bell et al.
7,730,413 B1 6/2010 Engel et al.
7,918,734 B2 4/2011 Gould
8,029,351 B2 10/2011 Kosaka et al.
8,131,649 B2 3/2012 Yen et al.
8,784,196 B2 7/2014 Little et al.
2001/0013681 A1 8/2001 Bruzzese et al.
2002/0045472 A1 4/2002 Adams
2002/0128057 A1 * 9/2002 Walker et al. ..... 463/20
2002/0142825 A1 10/2002 Lark et al.
2002/0142846 A1 10/2002 Paulsen
2002/0147047 A1 10/2002 Letovsky et al.
2002/0155873 A1 * 10/2002 Berman et al. ..... 463/16
2002/0173354 A1 11/2002 Winans et al.
2002/0183105 A1 12/2002 Cannon et al.
2002/0194505 A1 12/2002 Muschenborn
2003/0027624 A1 2/2003 Gilmore et al.
2003/0032478 A1 2/2003 Takahama et al.
2003/0032479 A1 2/2003 LeMay et al.
2003/0064771 A1 4/2003 Morrow et al.
2003/0064800 A1 4/2003 Jackson et al.
2003/0064801 A1 4/2003 Breckner
2003/0069074 A1 4/2003 Jackson
2003/0083943 A1 5/2003 Adams et al.
2003/0087690 A1 5/2003 Loose et al.
2003/0119579 A1 * 6/2003 Walker et al. ..... 463/20
2003/0130028 A1 7/2003 Aida et al.
2003/0162582 A1 8/2003 Gordon

(56) References Cited

U.S. PATENT DOCUMENTS

| | | | |
|---|---|---|---|
| 2003/0176214 | A1 | 9/2003 | Burak et al. |
| 2003/0216169 | A1 | 11/2003 | Walker et al. |
| 2003/0222876 | A1 | 12/2003 | Giemborek et al. |
| 2003/0236114 | A1 | 12/2003 | Griswold et al. |
| 2004/0009813 | A1 | 1/2004 | Wind |
| 2004/0023714 | A1 | 2/2004 | Asdale |
| 2004/0029636 | A1 | 2/2004 | Wells |
| 2004/0048671 | A1 | 3/2004 | Rowe |
| 2004/0063490 | A1 | 4/2004 | Okada |
| 2004/0066475 | A1 | 4/2004 | Searle |
| 2004/0087360 | A1 | 5/2004 | Chamberlain et al. |
| 2004/0103444 | A1 | 5/2004 | Weinberg et al. |
| 2004/0110557 | A1 | 6/2004 | Rowe |
| 2004/0116178 | A1 | 6/2004 | Okada |
| 2004/0117484 | A1 | 6/2004 | Singer et al. |
| 2004/0127284 | A1 | 7/2004 | Walker et al. |
| 2004/0147303 | A1 | 7/2004 | Imura et al. |
| 2004/0150162 | A1 | 8/2004 | Okada |
| 2004/0162146 | A1 | 8/2004 | Ooto |
| 2004/0166925 | A1 | 8/2004 | Emori et al. |
| 2004/0171423 | A1 | 9/2004 | Silva et al. |
| 2004/0180712 | A1 | 9/2004 | Forman et al. |
| 2004/0180721 | A1 | 9/2004 | Rowe |
| 2004/0183972 | A1 | 9/2004 | Bell |
| 2004/0192430 | A1 | 9/2004 | Burak et al. |
| 2004/0198485 | A1 | 10/2004 | Loose |
| 2004/0207154 | A1 | 10/2004 | Okada |
| 2004/0208126 | A1 | 10/2004 | Wassew et al. |
| 2004/0209666 | A1 | 10/2004 | Okada et al. |
| 2004/0209667 | A1 | 10/2004 | Emori et al. |
| 2004/0209668 | A1 | 10/2004 | Okada |
| 2004/0209671 | A1 | 10/2004 | Okada |
| 2004/0209678 | A1 | 10/2004 | Okada |
| 2004/0209683 | A1 | 10/2004 | Okada |
| 2004/0214635 | A1 | 10/2004 | Okada |
| 2004/0214637 | A1 | 10/2004 | Nonaka |
| 2004/0219968 | A1 | 11/2004 | Fiden et al. |
| 2004/0224747 | A1 | 11/2004 | Okada |
| 2004/0233663 | A1 | 11/2004 | Emslie et al. |
| 2004/0239582 | A1 | 12/2004 | Seymour |
| 2004/0254010 | A1 | 12/2004 | Fine |
| 2005/0020348 | A1 | 1/2005 | Thomas et al. |
| 2005/0020358 | A1 | 1/2005 | Cram |
| 2005/0032571 | A1 | 2/2005 | Asonuma |
| 2005/0037843 | A1 | 2/2005 | Wells et al. |
| 2005/0043086 | A1 | 2/2005 | Schneider |
| 2005/0049032 | A1 | 3/2005 | Kobayashi |
| 2005/0049046 | A1 | 3/2005 | Kobayashi |
| 2005/0059494 | A1 | 3/2005 | Kammler |
| 2005/0062410 | A1 | 3/2005 | Bell et al. |
| 2005/0063055 | A1 | 3/2005 | Engel |
| 2005/0079913 | A1 | 4/2005 | Inamura |
| 2005/0085292 | A1 | 4/2005 | Inamura |
| 2005/0096129 | A1 | 5/2005 | Walker et al. |
| 2005/0119052 | A1 | 6/2005 | Russell et al. |
| 2005/0153772 | A1 | 7/2005 | Griswold et al. |
| 2005/0153775 | A1 | 7/2005 | Griswold et al. |
| 2005/0153776 | A1 | 7/2005 | LeMay et al. |
| 2005/0164762 | A1 | 7/2005 | Smith et al. |
| 2005/0192090 | A1 | 9/2005 | Muir et al. |
| 2005/0193269 | A1 | 9/2005 | Haswell et al. |
| 2005/0197183 | A1 | 9/2005 | Walker et al. |
| 2005/0206582 | A1 | 9/2005 | Bell et al. |
| 2005/0208994 | A1 | 9/2005 | Berman |
| 2005/0215311 | A1 | 9/2005 | Hornik et al. |
| 2005/0233799 | A1 | 10/2005 | LeMay et al. |
| 2005/0239539 | A1 | 10/2005 | Inamura |
| 2005/0266912 | A1 | 12/2005 | Sekiguchi |
| 2005/0282638 | A1 | 12/2005 | Rowe |
| 2005/0285337 | A1 | 12/2005 | Durham et al. |
| 2006/0009273 | A2 | 1/2006 | Moshal |
| 2006/0041586 | A1 | 2/2006 | Nassef, Jr. |
| 2006/0063581 | A1 | 3/2006 | Harris et al. |
| 2006/0068898 | A1 | 3/2006 | Maya |
| 2006/0073870 | A1 | 4/2006 | Cannon |
| 2006/0079333 | A1 | 4/2006 | Morrow et al. |
| 2006/0089194 | A1 | 4/2006 | Joshi et al. |
| 2006/0094508 | A1 | 5/2006 | D'Amico et al. |
| 2006/0100014 | A1 | 5/2006 | Griswold et al. |
| 2006/0103951 | A1 | 5/2006 | Bell et al. |
| 2006/0105837 | A1 | 5/2006 | Walker et al. |
| 2006/0105841 | A1 | 5/2006 | Rom et al. |
| 2006/0125745 | A1 | 6/2006 | Evanicky |
| 2006/0143085 | A1 | 6/2006 | Adams et al. |
| 2006/0154729 | A1 | 7/2006 | LeMay et al. |
| 2006/0166727 | A1 | 7/2006 | Burak |
| 2006/0184626 | A1 | 8/2006 | Agapi et al. |
| 2006/0190482 | A1 | 8/2006 | Kishan et al. |
| 2006/0191177 | A1 | 8/2006 | Engel |
| 2006/0217202 | A1 | 9/2006 | Burke et al. |
| 2006/0247027 | A1 | 11/2006 | Walker et al. |
| 2006/0252504 | A1 | 11/2006 | Walker et al. |
| 2006/0252505 | A1 | 11/2006 | Walker et al. |
| 2006/0264256 | A1 | 11/2006 | Gagner et al. |
| 2006/0264257 | A1 | 11/2006 | Jaffe et al. |
| 2006/0282855 | A1 | 12/2006 | Margulis |
| 2006/0284574 | A1 | 12/2006 | Emslie et al. |
| 2006/0287063 | A1 | 12/2006 | Walker et al. |
| 2006/0290594 | A1 | 12/2006 | Engel et al. |
| 2007/0004510 | A1 | 1/2007 | Underdahl et al. |
| 2007/0004513 | A1 | 1/2007 | Wells et al. |
| 2007/0010315 | A1 | 1/2007 | Hein |
| 2007/0015569 | A1 | 1/2007 | Norton et al. |
| 2007/0024002 | A1 | 2/2007 | McMain et al. |
| 2007/0032288 | A1 | 2/2007 | Nelson et al. |
| 2007/0043616 | A1 | 2/2007 | Kutaragi et al. |
| 2007/0060317 | A1 | 3/2007 | Martin |
| 2007/0105617 | A1 | 5/2007 | Walker et al. |
| 2007/0121936 | A1 | 5/2007 | Guillou et al. |
| 2007/0129137 | A1 | 6/2007 | Walker et al. |
| 2007/0180400 | A1 | 8/2007 | Zotov et al. |
| 2007/0213124 | A1 | 9/2007 | Walker et al. |
| 2007/0243925 | A1 | 10/2007 | LeMay et al. |
| 2007/0243928 | A1 | 10/2007 | Iddings |
| 2007/0243934 | A1 | 10/2007 | Little et al. |
| 2008/0008188 | A1 | 1/2008 | Buga et al. |
| 2008/0009344 | A1 | 1/2008 | Graham et al. |
| 2008/0020816 | A1 | 1/2008 | Griswold et al. |
| 2008/0020839 | A1 | 1/2008 | Wells et al. |
| 2008/0020840 | A1 | 1/2008 | Wells et al. |
| 2008/0020841 | A1 | 1/2008 | Wells et al. |
| 2008/0039190 | A1 | 2/2008 | Walker et al. |
| 2008/0076574 | A1 | 3/2008 | Okada |
| 2008/0096655 | A1 | 4/2008 | Rasmussen et al. |
| 2008/0113747 | A1 | 5/2008 | Williams et al. |
| 2008/0125219 | A1 | 5/2008 | Williams et al. |
| 2009/0098943 | A1 | 4/2009 | Weber et al. |
| 2009/0104954 | A1 | 4/2009 | Weber et al. |
| 2009/0156303 | A1 | 6/2009 | Kiely et al. |
| 2009/0233705 | A1 | 9/2009 | LeMay et al. |
| 2010/0003642 | A1 | 1/2010 | Russell et al. |
| 2010/0105454 | A1 | 4/2010 | Weber et al. |

FOREIGN PATENT DOCUMENTS

| | | |
|---|---|---|
| EP | 0454423 | 10/1991 |
| EP | 0484103 | 5/1992 |
| EP | 0769769 | 4/1997 |
| EP | 0946028 A2 | 9/1999 |
| EP | 0997857 | 10/1999 |
| EP | 1195184 | 4/2002 |
| EP | 1255234 | 11/2002 |
| EP | 1260928 | 11/2002 |
| EP | 1282088 | 2/2003 |
| EP | 1462152 | 9/2004 |
| EP | 1492063 | 12/2004 |
| EP | 1524617 | 4/2005 |
| GB | 1464896 | 2/1977 |
| GB | 2120506 | 11/1983 |
| WO | WO/98/52665 | 11/1998 |
| WO | WO/99/42889 | 8/1999 |
| WO | WO/99/44095 | 11/1999 |
| WO | WO/01/15127 | 3/2001 |
| WO | WO/01/15128 | 3/2001 |

(56) References Cited

FOREIGN PATENT DOCUMENTS

| | | | |
|---|---|---|---|
| WO | WO/01/15132 | | 3/2001 |
| WO | WO/01/09664 | | 8/2001 |
| WO | WO 02/055163 | A2 | 7/2002 |
| WO | WO/02/073501 | | 9/2002 |
| WO | WO/03/023647 | | 3/2003 |
| WO | WO/03/039699 | | 5/2003 |
| WO | WO 03/089082 | A1 | 10/2003 |
| WO | WO 03/093986 | A2 | 11/2003 |
| WO | WO/2004/001486 | | 12/2003 |
| WO | WO/2004/102520 | | 11/2004 |
| WO | WO 2005/070509 | | 8/2005 |
| WO | WO 2005/099839 | | 10/2005 |
| WO | WO/2006/033986 | | 3/2006 |
| WO | WO/2006/034192 | | 3/2006 |
| WO | WO/2006/038819 | | 4/2006 |
| WO | WO/2006/039132 | | 4/2006 |
| WO | WO/2007/032916 | | 3/2007 |
| WO | WO/2007/040413 | | 4/2007 |
| WO | WO/2007/120444 | | 10/2007 |
| WO | WO/2007/120450 | | 10/2007 |
| WO | WO/2008/061068 | | 5/2008 |
| WO | WO/2009/009269 | | 1/2009 |
| WO | WO/2009/036445 | | 3/2009 |
| WO | WO/2009/140096 | | 11/2009 |
| WO | WO/2009/143274 | | 11/2009 |
| WO | WO/2010/056418 | | 5/2010 |
| WO | WO/2010/120451 | | 10/2010 |

* cited by examiner

VIDEO GAMING DEVICE HAVING A SYSTEM AND METHOD FOR COMPLETING WAGERS AND PURCHASES DURING THE CASH OUT PROCESS

CROSS REFERENCE TO RELATED APPLICATIONS

The present application claims the benefit of priority of U.S. Provisional Patent Application Ser. No. 60/636,733, filed Dec. 16, 2004 and entitled "Gaming Device Having A System and Method For Completing Wagers and Purchases During the Cash Out Process", the entirety of which is incorporated by reference herein as part of the present disclosure.

BACKGROUND OF THE INVENTION

1. Field of the Invention

This invention relates generally to the video electronic game of chance and more particularly, to a system and method for allowing a player to make additional gaming wagers on games offered by the gaming establishment and also purchase items available for sale during the cash out process.

2. Description of Prior Art

The gaming industry has been using video electronic games of chance such as video poker for many years to entertain players and generate revenue for its establishments. While the number of different types of video games available to the player has increased dramatically over the past few years, the versatility of the electronic gaming devices to allow the player to use his winnings for other purposes besides playing that game has not changed much.

A typical video electronic game of chance requires the player to insert a wagerable amount of money into that particular device each time the player wishes to play a certain game. If the player wants to play video poker, he must find a video poker machine which is available and insert money into the device to play. If the player wants to play video Keno, he must find a video Keno machine which is available and insert money into the device to play. If the player wants to place a wager on a sporting event he must go to the gaming establishments sports book and place a separate wager. If the player wants to go to a show that is playing in town, he must go to the gaming establishments event reservations to purchase the tickets. All of this takes time away from the player from gambling and creates inefficiencies for the gaming establishment.

A need exists for a more flexible and versatile use of the video electronic game of chance cash out system. The gaming establishment can increase revenue and improve patronage efficiency and overall experience by providing versatility to the video electronic game of chance.

SUMMARY OF THE INVENTION

Video electronic games of chance have become extremely popular over the past few years. Casinos which have grown tremendously in popularity generate a large amount of their daily revenue from video electronic games of chance (Video Poker is just one example of these video slot machine games). This invention involves allowing a player playing a video electronic game of machine to make a separate wager on a different game of chance such as lottery or keno being conducted at the gaming establishment or elsewhere prior to the player ending its gaming session on the video electronic game of machine. Currently, when a player ends their session of play on a video electronic games of chance they typically push a "cash out" button to have any money or credits owed to them returned either through cash or voucher. In the present invention, when the player pushes the "cash out" button a menu pops up on the screen asking the player whether they would be interested in making a wager or purchasing a ticket related to a different game of chance such as a lottery ticket, keno ticket of sports wagering. The cost of the ticket will then be deducted from the money or credits on the video slot machine and the machine will then dispense the wagering ticket to the player along with any monies owed to the player. The player will also be give an option to purchase items sold by the gaming establishment such as tickets to a show.

An objective of this invention is to provide additional options for the player during the cash out process while playing a video electronic game of chance other than receiving money or ticket voucher.

An objective of this invention is to allow a player to play other games of chance offered by the gaming establishment such as placing a wager on a sporting event while playing on a video electronic game of chance.

An objective of this invention is to allow a player to purchase items offered by the gaming establishment such as purchasing a ticket to a show while playing a video electronic game of chance.

An objective of this invention is to have a device that allows a player to have the option to play many different game of chance from the same device and also purchase items using the money the player has accrued while playing a video electronic game of chance.

DETAILED DESCRIPTION OF THE PREFERRED EMBODIMENTS

Figure 1:
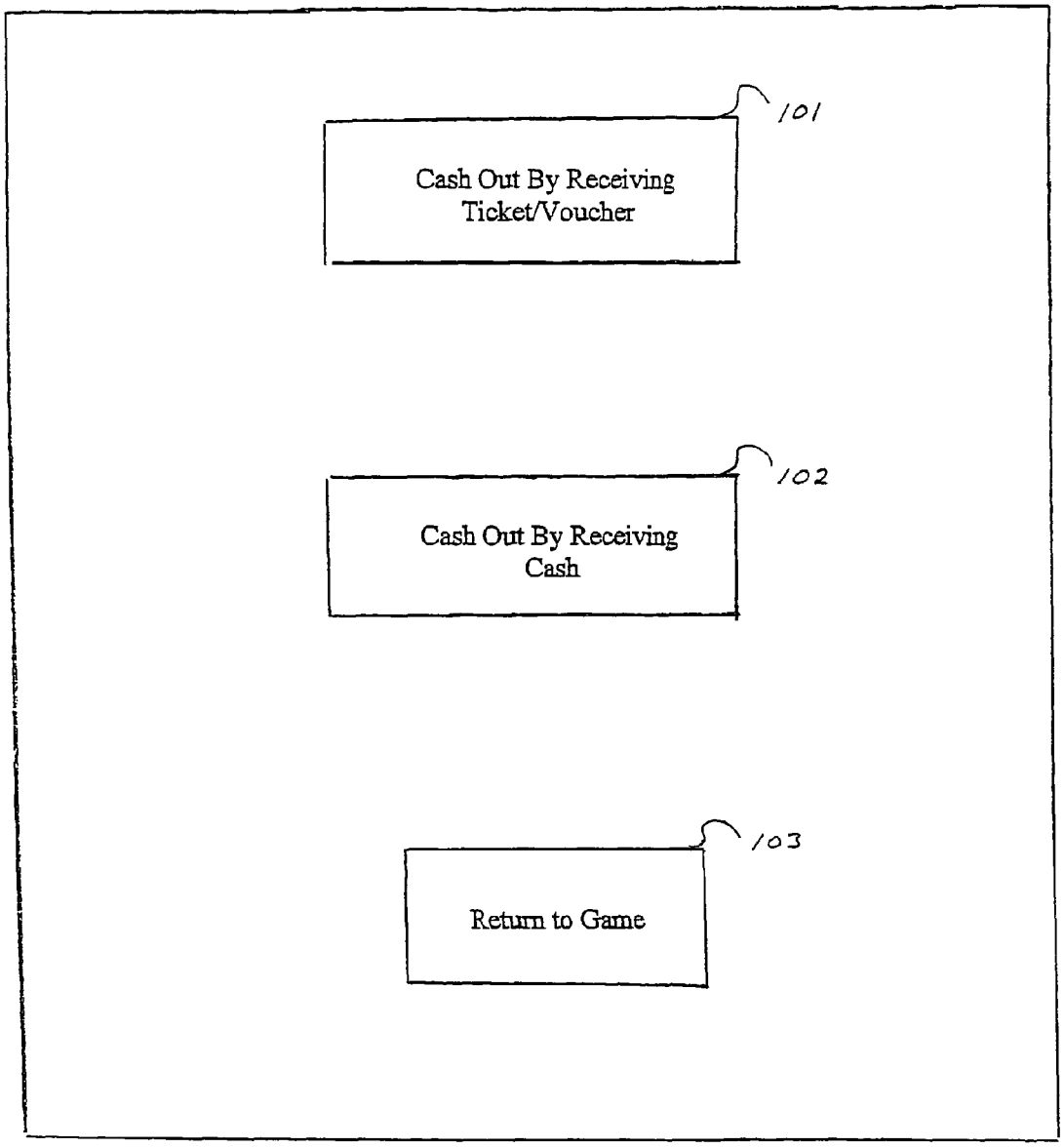
FIG. 1 is an example of the gaming device's cash out menu window.

FIG. 1 shows an enlarged front view of the video monitor of the gaming device illustrating the preferred cash out menu embodiment of the present invention. When the player presses or selects the cash out button or selector on the gaming device, the monitor displays a cash out menu similar to the menu shown in FIG. 1. A method for operating the present invention is discussed below in association with FIG. 6.

Figure 7:
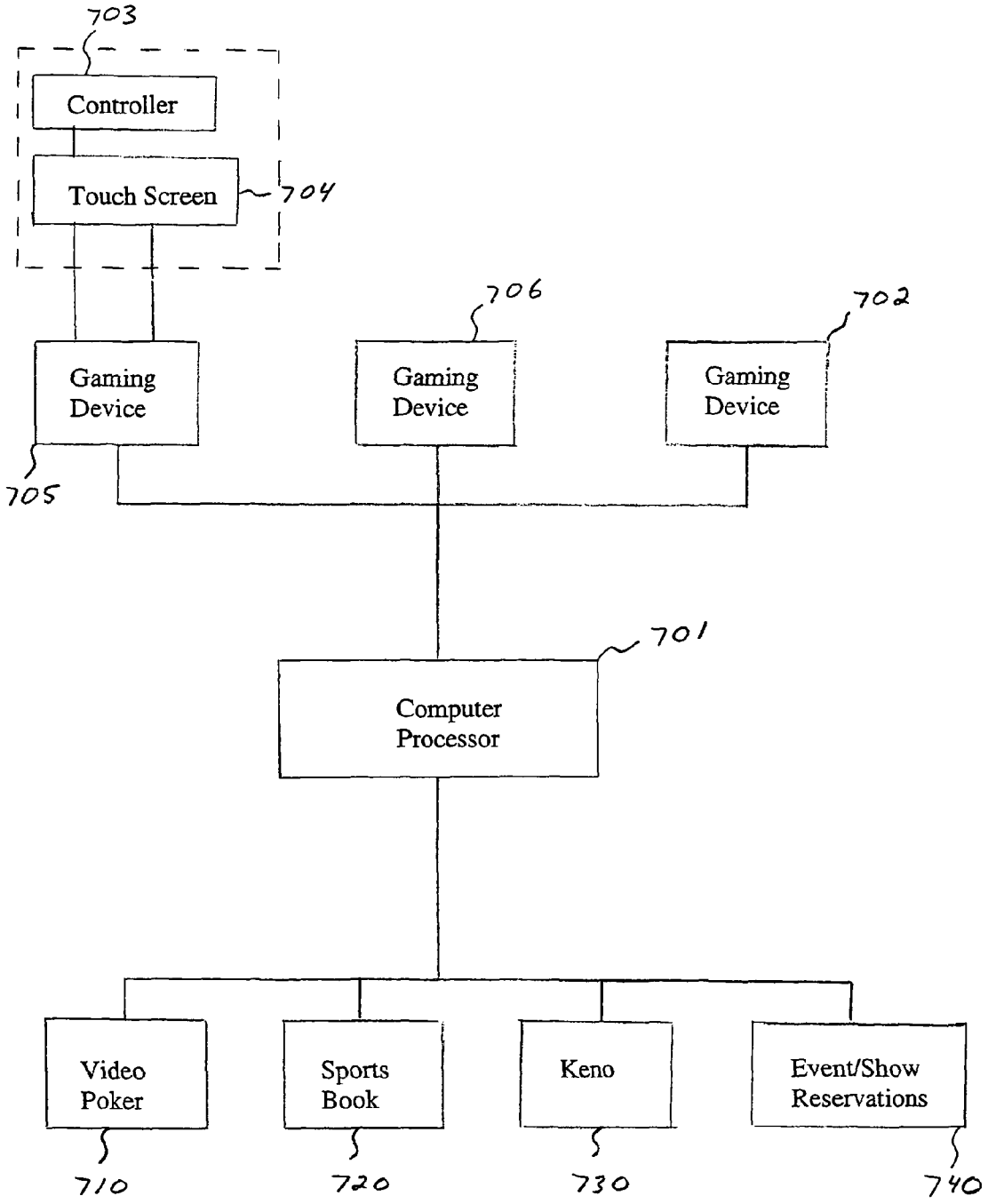
FIG. 7 is a schematic block diagram of the electronic configuration of one embodiment of the gaming device of the present invention.

As illustrated in FIG. 7, the general electronic configuration of the invention preferably includes: a primary computer processor 701 which allows communications to occur between the gaming devices 702 and the gaming establishments event/show reservation system 740, video poker gaming devices 720, Keno game 730, Race and Sports book and any other gaming or non-gaming electronic system the gaming establishment wants to allow access too. The present invention is preferably embodied in a video monitor having a touch screen 704 and associated touch screen technology along with a controller 703.

Figure 6:
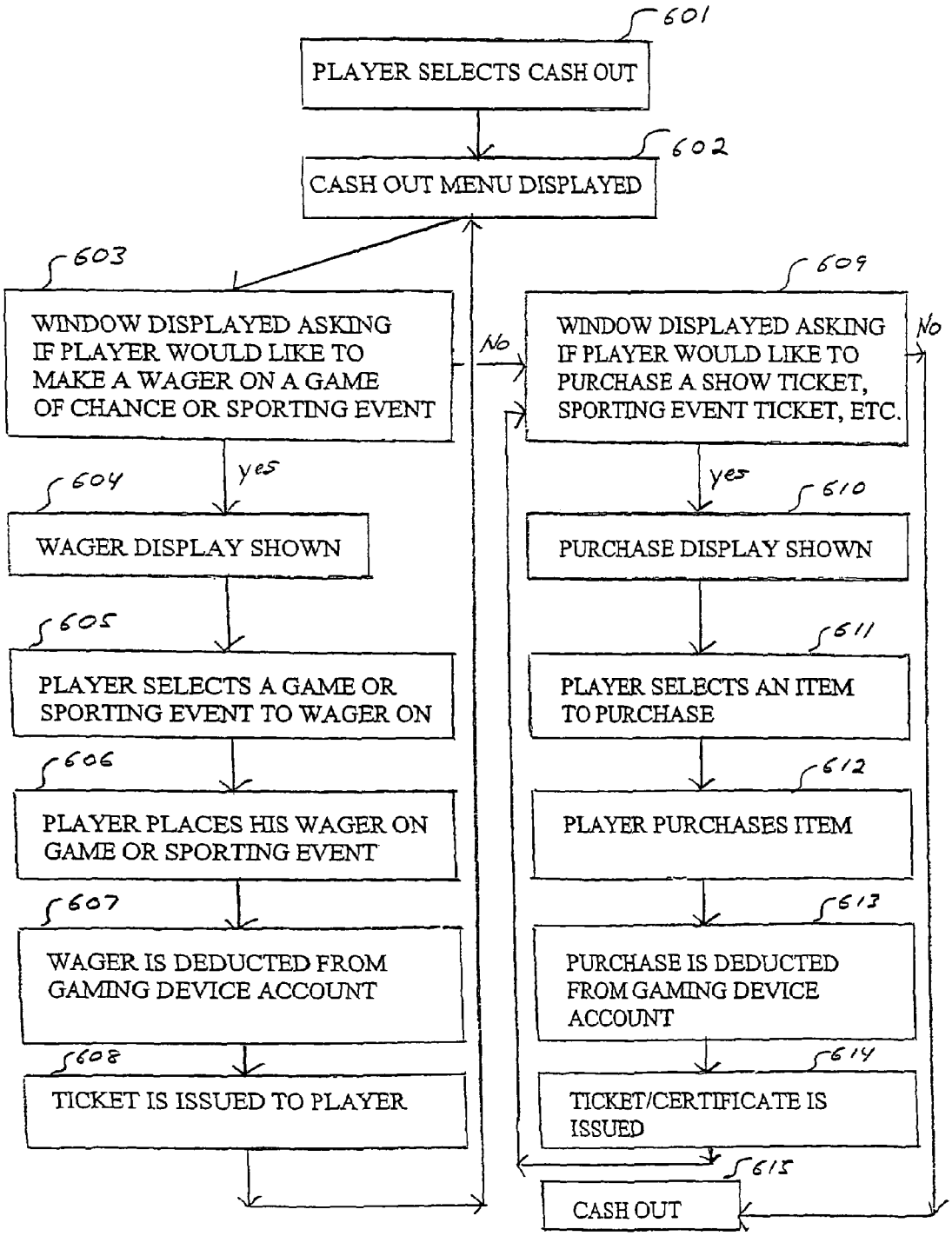
FIG. 6 is a flow chart illustrating the operation of the gaming device.

FIG. 6 shows a schematic flow diagram illustration one operating method of the present invention. It should be understood that individuals skilled in the art of computer programming and video gaming device design can most certainly create many different but similar operating methods in the future for the embodiments described herein. The following disclosure is not meant to limit the present invention to the operating method described in FIG. 6 herein.

Referring to FIG. 6, preferably upon the player's selection of the cash out button or selector 601 on the gaming device such as a video poker slot machine or any other gaming device that contains a monitor, the game displays a cash out menu 602 as indicated in FIG. 1. According to FIG. 1, after the cash out menu is displayed, the player can: (i) execute a ticket cash out as indicated by 101; (ii) execute a cash cash out as indicated by 102; or (iii) return to the game that was being played as indicated by 103. These option are completed when the player touches the video screen in the area indicated by 101, 102 and 103 on FIG. 1.

Figure 2:
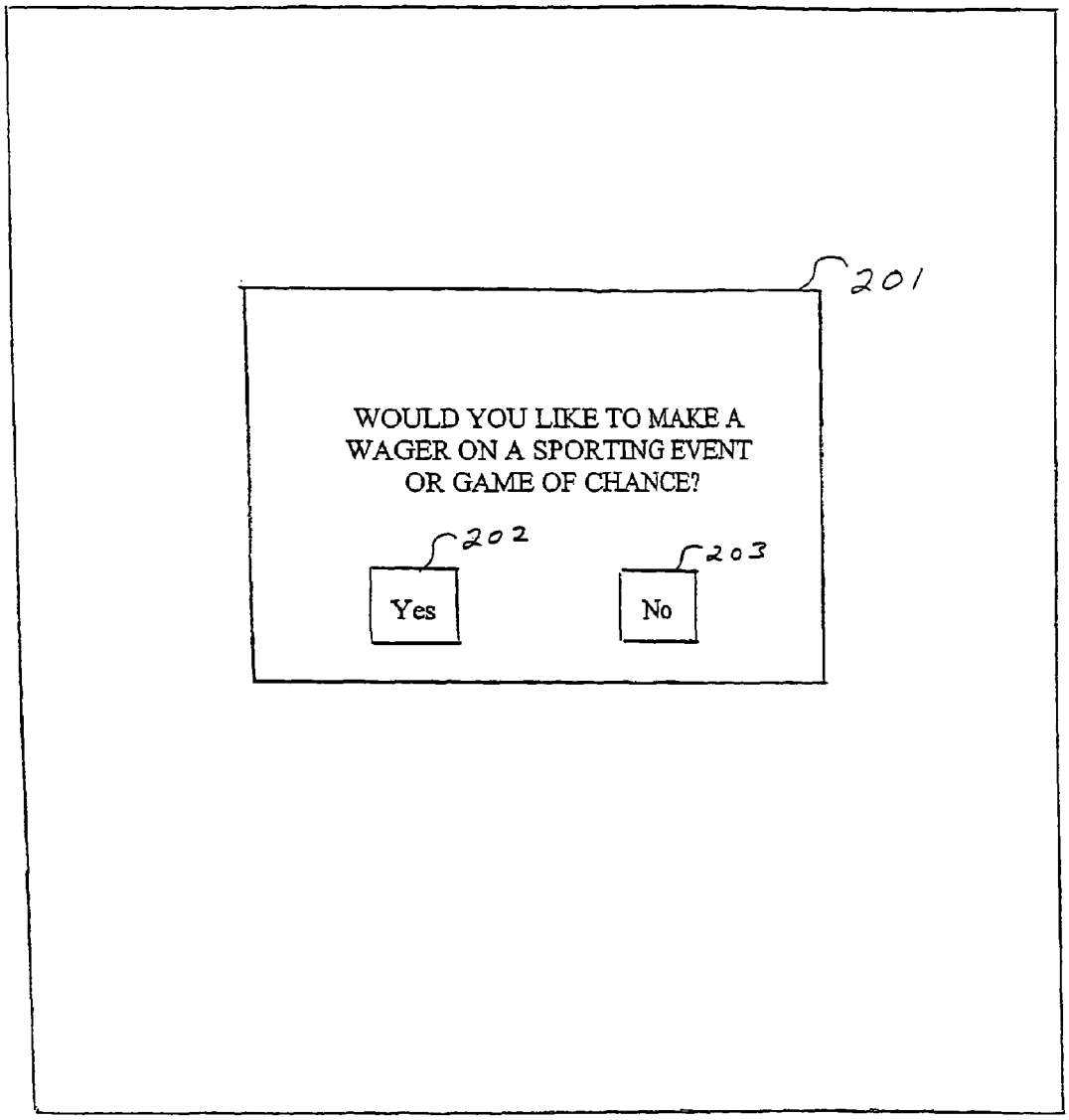
FIG. 2 is an example of the gaming device's wager option window.
Figure 4:
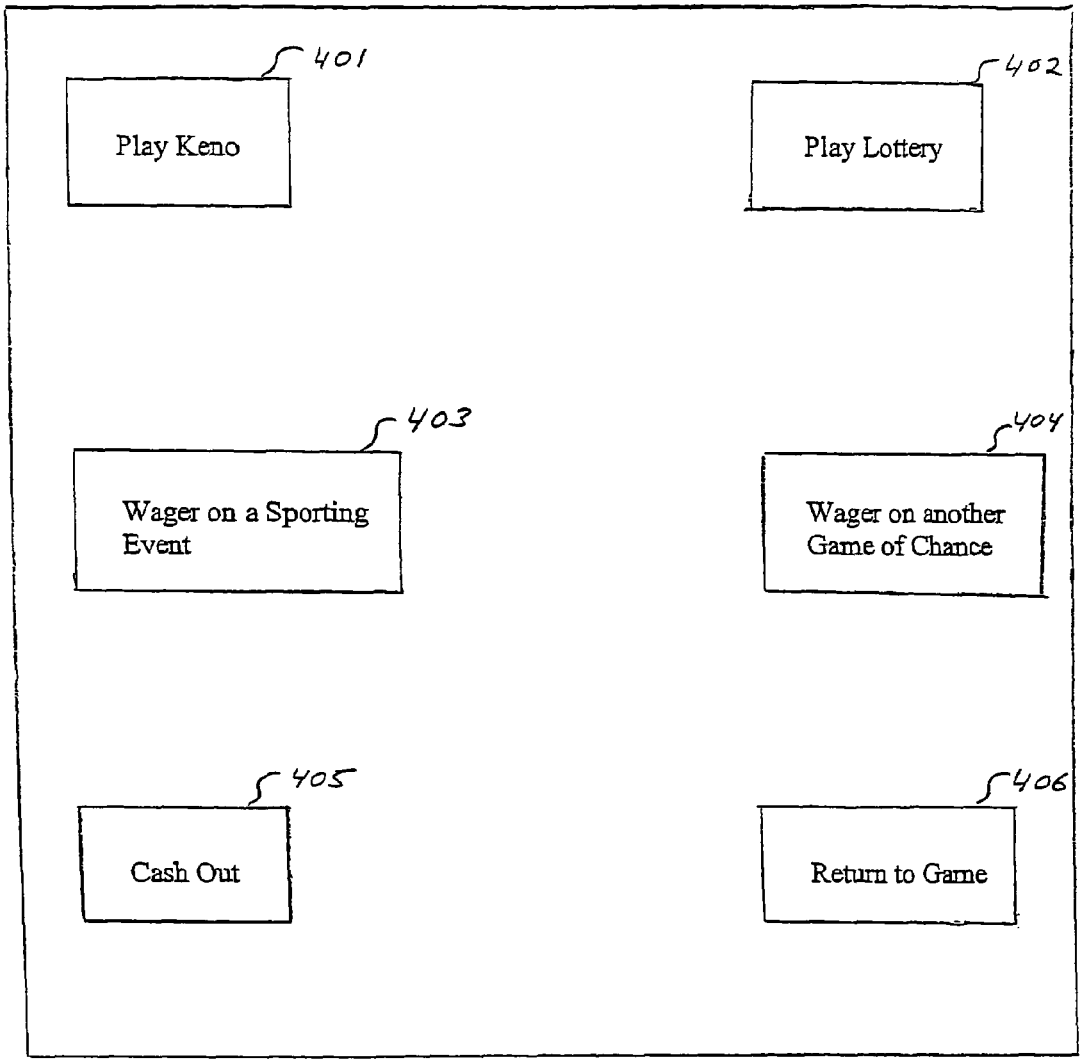
FIG. 4 is an example of the gaming device's wager menu window

Upon the player selecting a ticket cash out option 101 or cash cash out option 102, a wager option window is displayed on the monitor which asks the player whether the player would like to make a wager on a sporting event or game of chance 603 as shown in FIG. 2 and represented by 201. If the player selects yes by touching the screen as indicated by 202, a wager menu window is displayed on the monitor indicating what wagers can be made 604 similar to what is shown in FIG. 4. The preferred embodiment gives the player several different options including: (i) wagering on a keno game 401; (2) wagering on a lottery game 402; (iii) wagering on a sporting event 403; (iv) wagering on some other game of chance 404; (v) cashing out 405; or (vi) returning to the game that was being played on the gaming device 406. The Player selects which option he would desire by touching the video screen in the appropriate location. If the player places a wager 605, the amount of the wagered amount is then deducted from the cash out amount being held in memory by the gaming device 607. After the wager transaction is completed, the player is issued a wager ticket from the gaming device 608. After the wager ticket is issued, the monitor redisplays the wager option window asking whether the player would like to make a wager on a sporting event or game of chance 603.

Figure 3:
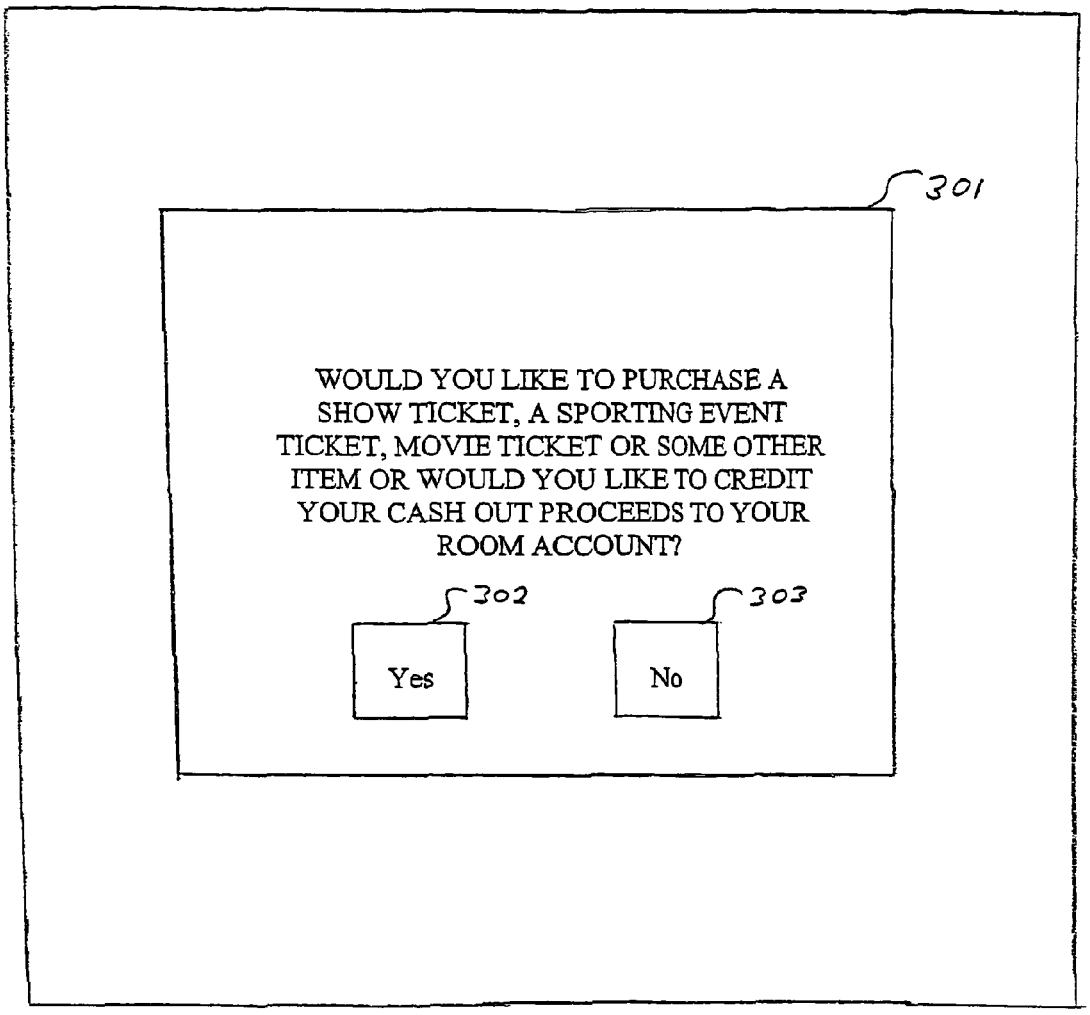
FIG. 3 is an example of the gaming device's purchase option window.
Figure 5:
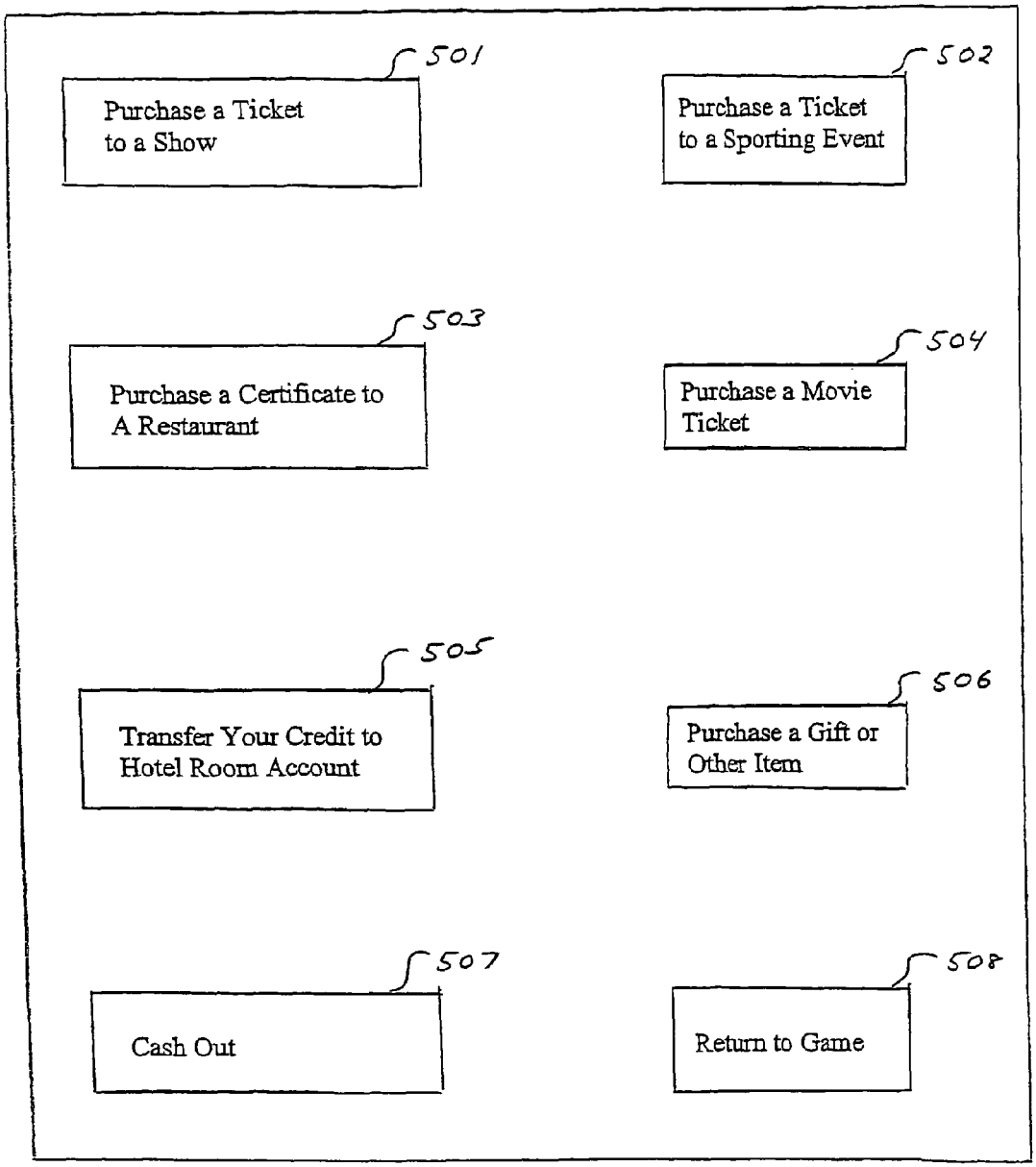
FIG. 5 is an example of the gaming device's purchase menu window.

Referring to FIG. 2, if the player selects No by touching the video screen as indicated by 203, a purchase option window is displayed asking whether the player would like to purchase a show ticket, sporting event ticket, etc. similar to what is shown in FIG. 3 and represented by 301. If the player selects yes by touching the screen as indicated by box 302, a purchase menu window is displayed on the monitor indicating what purchases can be made 610 similar to what is shown in FIG. 5. The preferred embodiment gives the player several different options including: (i) purchasing a Ticket to a show 501; (2) purchasing a ticket to a sporting event 502; (iii) purchasing a certificate to a restaurant 503; (iv) purchasing a ticket to a movie 504; (v) transferring the credit on the gaming device to the players hotel room account 505; (vi) purchasing a gift or other item 506; (vii) cashing out 507; or returning to the game that was being played on the gaming device 508. The Player selects which option he would desire by touching the video screen in the appropriate location 611. If the player makes a purchase 612, the amount of the purchase is then deducted from the cash out amount being held in memory by the gaming device 613. After the wager transaction is completed, the player is issued a purchase ticket or certificate from the gaming device 614. After the purchase ticket or certificate is issued, the monitor redisplays purchase option window asking whether the player would like to make a purchase 609. If the player selects No, the gaming device cashes the Player out based upon the option chosen during the cash out menu display 602.

If the player selected cash cash out option then the gaming device will dispense coins or currency to the player while if the player selected ticket cash out the gaming device will dispense a ticket or voucher representing the amount owed to the player.

Another preferred embodiment of the invention has the cash out option menu is displayed when the player initially inserts money, credit card or the gaming establishments player's card into the gaming device.

I claim:

1. A method of operating a gaming device, said method comprising:

(a) if a physical item is received via an acceptor of the gaming device, establishing a credit balance of the gaming device based, at least in part, on a monetary value associated with the received physical item, said physical item being selected from the group consisting of: a cash-in ticket associated with the monetary value and a unit of currency;

(b) receiving a wager on a play of a wagering game, said credit balance being decreasable based on said received wager on the play of the wagering game;

(c) for the play of the wagering game:

(i) causing at least one processor to randomly determine a game outcome, (ii) causing at least one electronic display device to display information regarding said randomly determined game outcome, and (iii) causing said at least one electronic display device to display any award associated with the randomly determined game outcome, said credit balance being increasable based on any displayed award associated with the randomly determined game outcome;

(d) receiving an input from a player, via a cashout device of the gaming device, to cash-out said credit balance;

(e) causing said at least one electronic display device to display an indication of a first option to utilize at least part of said credit balance to participate in an additional wagering event, said additional wagering event associated with a first ticket having a predefined cost and having an outcome being determined independently of and remotely from said gaming device;

(f) receiving a first input from said player, via at least one player input device, to: (i) participate in said additional wagering event, or (ii) decline said first option;

(g) for each first input received from said player to participate in said additional wagering event, causing at least one printer to print the first ticket associated with said additional wagering event;

(h) regardless of whether said player participates in said additional wagering event or declines said first option, and, without said player requesting the display of any indication of any second option:

(i) automatically causing said first option to no longer be displayed, (ii) thereafter, automatically causing said at least one electronic display to display an indication of a second option to utilize at least part of said credit balance for a non-wagering event, (iii) receiving a second input from said player, via said at least one player input device, to: (A) utilize at least part of said credit balance for the non-wagering event, or (B) decline said second option, and (iv) for each second input received from said player to utilize at least part of said credit balance for the non-wagering event, causing the at least one printer to print a second ticket corresponding to said selected non-wagering event; and (i) after receiving said second input from said player, causing the at least one printer to print a cash-out ticket corresponding to any remaining credit balance of said gaming device.

2. The method of claim 1, which includes, if said player participates in said additional wagering event, presenting a first menu of at least two different wagering events.

3. The method of claim 2, wherein said additional wagering event is selected from the group consisting of: a keno game, a lottery game and a sporting event.

4. The method of claim 1, which includes, if said player utilizes at least part of said credit balance for the non-wagering event, presenting a second menu of at least two non-wagering events.

5. The method of claim 4, wherein said non-wagering event is selected from the group consisting of: a sporting event, a movie, a show, a gift, a lodging service and a food service.

6. The method of claim 1, which includes, if said player participates in said additional wagering event, presenting a first menu of at least two wagering events and an option to cashout and if said player utilizes at least part of said credit balance for the non-wagering event, presenting a second menu of at least two non-wagering events and said option to cash-out.

7. The method of claim 6, which includes, if said player by elects said cash-out option from said first menu, causing said first menu to no longer be displayed and causing said indication of the second option to be displayed.

8. The method of claim 6 wherein if said first ticket associated with said wagering event is printed, re-presenting said first option.

* * * * *